United States Patent [19]

Carlson

[11] Patent Number: 5,018,469

[45] Date of Patent: May 28, 1991

[54] VARIABLE RATIO STEERING HELM

[75] Inventor: John Carlson, Wayne, Pa.

[73] Assignee: Teleflex Incorporated, Limerick, Pa.

[21] Appl. No.: 451,564

[22] Filed: Dec. 18, 1989

Related U.S. Application Data

[63] Continuation-in-part of Ser. No. 386,503, Jul. 27, 1989, abandoned.

[51] Int. Cl.[5] ..... B63H 25/00

[52] U.S. Cl. ..... 114/144 R; 74/388 PS; 74/468; 180/79.3; 180/147

[58] Field of Search ..... 114/144 R, 154–161; 440/60; 180/79.3, 147; 74/89 H, 89.12, 422, 468, 480 B, 498, 388 PS, 89.18, 89.22

[56] References Cited

U.S. PATENT DOCUMENTS

| | | | |
|---|---|---|---|
| 428,249 | 5/1890 | Harfield | 114/159 |
| 2,953,932 | 9/1960 | Lincoln | 180/147 |
| 2,973,658 | 3/1961 | Bishop | 74/468 |
| 3,208,300 | 9/1965 | Morse | 74/498 |
| 3,225,620 | 12/1965 | Dubin | 114/154 |

*Primary Examiner*—Jesus D. Sotelo

*Attorney, Agent, or Firm*—Reising, Ethington, Barnard, Perry & Milton

[57] ABSTRACT

A boat steering assembly (10) having a substantially circular rotary gear (12) engaging an output gear such that the leverage is varied between the output gear (16, 16') and the steering wheel (32). The steering wheel (32) has a shaft gear (28) engaging in idler gear (22) which eccentrically rotates the circular gear (12) about the first axis (14). The eccentrically rotating circular gear (12) engages the output gear (16, 16') having a partially sinusoidal profile thereby automatically varying the distance (i.e., leverage) between the first axis (14) and a point of contact (52) between the circular (12) and output (16, 16') gears.

16 Claims, 3 Drawing Sheets

VARIABLE RATIO STEERING HELM

RELATED APPLICATION

This is a continuation-in-part of U.S. Ser. No. 386,503, titled Variable Ratio Rack Steering Helm, filed July 27, 1989, now abandoned.

TECHNICAL FIELD

The subject invention relates to a remote control marine steering system, and more particularly, to a mechanical steering assembly with a mechanical advantage between a steering wheel and a rudder.

BACKGROUND ART

Mechanical marine steering systems are frequently of the rack and pinion gear type. Such steering systems usually include a rotary gear (i.e., pinion gear) rotatably engaging an output gear (i.e., rack gear) in response to rotation from a steering wheel. The output gear typically includes a cable attached thereto as attached to a rudder or an outdrive of a marine engine for remotely controlling the movement thereof. The rudder or outdrive usually pivots about a vertical axis for directing the flow of water thereby.

As the rudder or outdrive rotation increases, the flow supplied by the passing water increases to likewise increase the required steering input force. In other words, as the rudder increasingly becomes transverse to the water flow, the force (i.e., drag) placed on the rudder by the passing water increases. This, in turn, increases the torque necessary to rotate the steering wheel.

In known prior art steering systems, the increasing rudder forces are overcome by providing a plurality of gearing mechanism, most of which require manual shifting between gears by the operator.

The U.S. Pat. No. 3,225,620 issued to Dubin discloses a multiple ratio steering system including a steering shaft with a beveled gear attached on the end thereof. The beveled gear engages with a second beveled gear connected to a shaft which, in turn, rotates a pair of spur gears. The spur gears are slideable along the shaft by means of a key connected to an adjustment rod. The first spur gear is engaged with a first pinion gear, or the second spur gear is engaged with a second pinion gear, depending on the desired steering ratio. The rotation of both pinion gears is about a second shaft having a screw gear attached thereon. The screw gear rotation is translated to an output shaft gear, thus causing rotation of an output shaft. A major deficiency in this system is that the variable ratio depends on the manual selection of four different gears mounted concentrically on two different shafts.

The U.S. Pat. No. 4,244,316 to Kulischenko discloses an input shaft connected to a steering wheel having a key thereon. The input shaft can be locked in either one or two different positions by engaging pins. In the first position, the input shaft having the key thereon engages the driver pulley causing a driven pulley to rotate by virtue of a timing belt operatively engaged therebetween. The driven pulley is provided with a smaller diameter than the driver pulley and thus, a single revolution of driver pulley will produce a plurality of revolutions of the driven pulley. The driven pulley rotates about the same shaft as a second driver pulley. The second driver pulley causes a second driven pulley to rotate therewith by virtue of a second timing belt operatively engaged therebetween. Similarly, a single revolution of the second driver pulley will produce a plurality of revolutions of the second driven pulley. Thus, the Kulischenko patent discloses six revolutions of the second driven pulley with one revolution of the steering wheel. With the input shaft in the first position, the operator is given a mechanical advantage through a plurality of pulley-belt systems. In addition, when the input shaft is in the second position, the key is disengaged from the pulley-belt system thereby directly rotating the output shaft. The Kulischenko system, however, has the similar deficiency of requiring the operator to manually select between a plurality of gearing mechanisms to selectively increase or decrease the mechanical advantage.

SUMMARY OF THE INVENTION AND ADVANTAGES

A boat steering assembly of the type for actuating a steering element in response to rotary inputs at a steering wheel comprises a rotary gear means supported for rotation about a first axis. The rotary gear means includes a driving periphery spaced radially from the first axis. The assembly includes input means associated with the rotary gear means for rotating the rotary gear means about the first axis. In addition, the assembly includes an output gear including an engagement periphery for engaging the driving periphery at the point of contact. The boat steering assembly is characterized by the driving periphery and engagement periphery having profiles for automatically varying the distance between the first axis and the point of contact as the rotary gear means rotates to increase the leverage between the input means and the output gear when the distance between the first axis and the point of contact of contact decreases.

The automatic varying of the distance between the first axis and the point contact provides the advantage of increased leverage between the input means and the output means. In other words, the operators mechanical advantage automatically varies as the distance between the first axis and the point of contact decreases. The increase in mechanical advantages allows the operator to counteract increasing rudder forces with no need to engage or disengage, e.g., shift gears.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

A boat steering assembly is generally shown at 10 in the Figures. The assembly 10 provides increased mechanical advantage by automatically varying the ratio between the input force and the output force. The assembly 10 includes a circular gear 12 mounted eccentrically on a first axis generally indicated at 14 and an output gear 16, 16' having a partially sinusoidal periphery 18.

Figure 1:
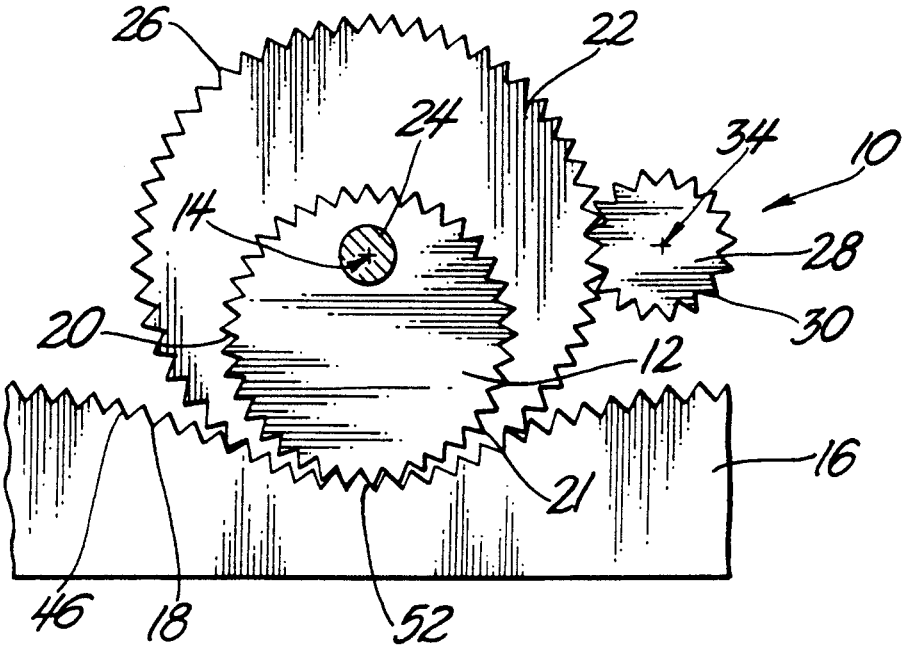
FIG. 1 is a front view of a gearing mechanism constructed in accordance with the subject invention.

The circular gear 12 rotates eccentrically about the first axis 14 and includes a plurality of radially spaced teeth 20 defining a driving periphery 21 having a profile for engaging the output gear 16, 16'. In addition, the first axis 14 includes a generally circular intermediate idler gear 22 mounted concentrically thereon. The first axis 14 comprises an idler shaft 24 and may be joined to the circular gear 12 and the idler gear 22 by either a welding, a keyway, or any other suitable connection means well known in the art. The idler gear 22 is typically of greater diameter than the circular gear 12 and includes a plurality of teeth 26 spaced radially thereon for engaging a shaft gear 28. The shaft gear 28 includes a plurality of radially spaced teeth 30 thereon and is typically connected to a boat steering wheel 32 and usually of a smaller diameter than the circular gear 12. The shaft gear 28 rotates about a second axis generally indicated at 34 spaced laterally and parallel to the first axis 14 (as best shown in FIG. 1). The second axis 34 is a steering wheel shaft 36 extending from the steering wheel 32.

The diameters of the shaft 28 and idler 22 gears can be of any size, however, as is well known, a substantially smaller shaft gear 28 engaging a larger idler gear 22 typically provides the best input ratio.

Figure 2:
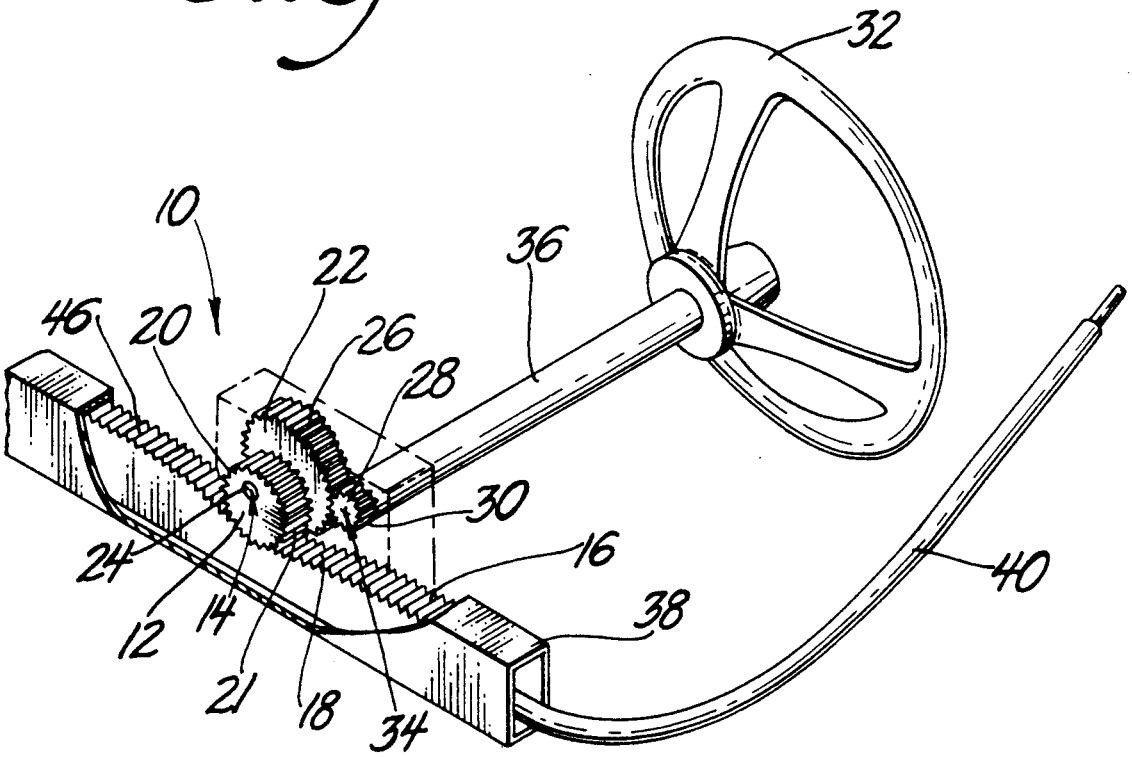
FIG. 2 is a perspective view of the steering assembly shown in FIG. 1 including a boat steering wheel and remote control cable.
Figure 3:
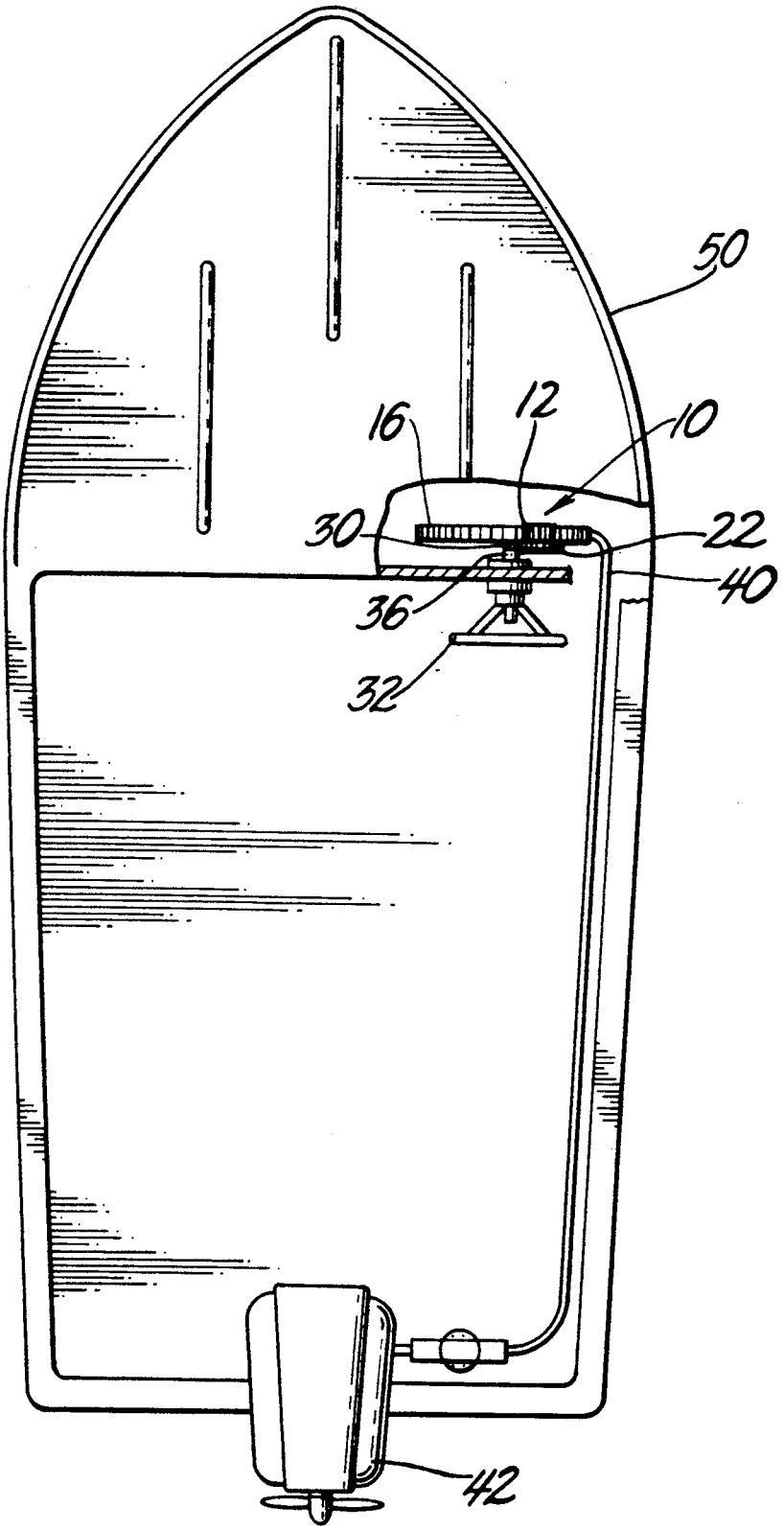
FIG. 3 is a plan view of a boat including the assembly shown in FIG. 2.

One embodiment of the output gear includes a linear gear 16 shown in FIGS. 1–3. The linear gear 16 is substantially rectangular having the engagement periphery 18 being defined by a partially sinusoidal profile. The partially sinusoidal profile 18 includes a plurality of spaced teeth 46 for mating with the teeth 20 on the circular gear 12. In the embodiment shown, the partially sinusoidal profile 18 of the linear gear 16 has a negative amplitude at the mid portion of the linear gear 16.

The linear gear 16 is slideably disposed in a housing 38 and translates the rotary motion of the circular gear 12 into linear motion. This linear motion is typically used to actuate either a single steering cable 40 or a conventional double cable steering assembly (not shown) to thereby pivot either the rudder or a marine engine 42 (as best shown in FIG. 3). The steering cable 40 is positioned on the linear gear 16 as is well known in the art. In addition, the linear gear 16 may transmit the linear motion by use of a pair of cables extending from both sides of the linear gear as known.

Figure 4:
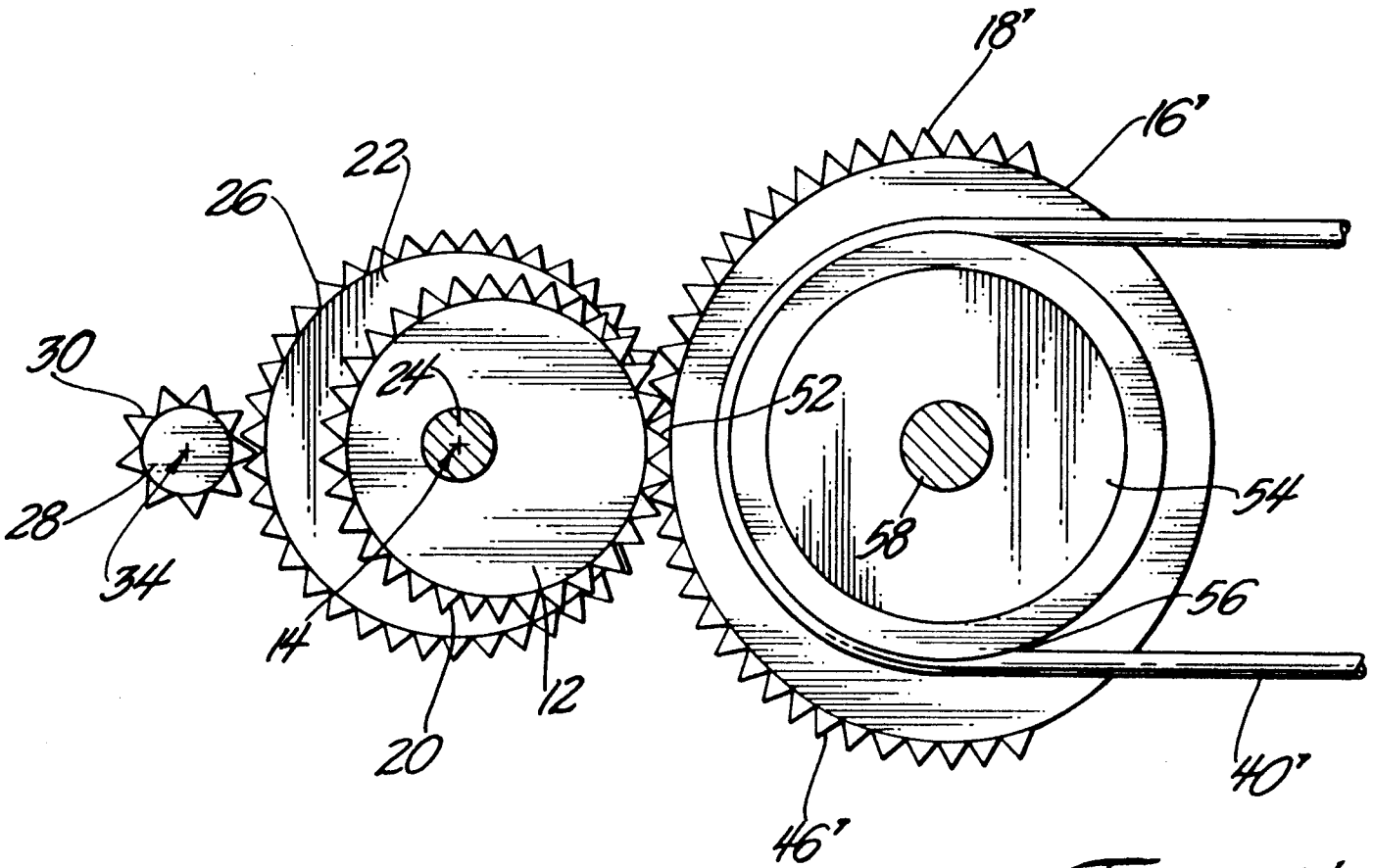
FIG. 4 is a front view of a second embodiment of the gearing mechanism constructed in accordance with the subject invention.

Another embodiment of the output gear includes an elliptical gear 16' shown in FIG. 4 having like numerals. The elliptical gear 16' includes a partially sinusoidal periphery 18' and a plurality of teeth 46' spaced thereon. The periphery 18' is partially sinusoidal thereby allowing the distance between the first axis 14 and a point of contact 52' to decrease as the circular gear 12 rotates.

The elliptical gear 16' includes a helix gear 54 fixed thereto having a circumferential recess 56 for guiding a steering cable 40' thereabout. The elliptical gear 16' and the helix gear 54 are mounted concentrically about a third axis 58.

As stated, the steering cable 40 and 40' are used to actuate a rudder or a marine engine 42 (as best shown in FIG. 3).

In operation, a marine vessel operator rotates the steering wheel 32 to pivot the rudder or marine engine 42 and thereby position the boat 50. When the steering wheel 32 rotates, the steering shaft 36 rotates and thus rotates the shaft gear 28 about the second axis 34. The teeth 30 of the shaft gear 28 engage the idler gear teeth 26 and thus rotate the idler gear 22 concentrically about the first axis 14. The number of revolutions of the idler gear 22 is proportional to the ratio of the idler gear diameter to the shaft gear diameter Measurements given herein are by way of example only. It has been found that a 13 tooth shaft gear and a 46 tooth idler gear results in one full turn of the idler gear 22 from 3.83 turns of the steering wheel. The circular gear 12 is 0.25 inches offset from the geometric center and 2.5 inches in diameter. Because the idler gear 22 and the circular gear 12 are affixed to the idler shaft 24 any rotation of the idler gear 22 results in rotation of the circular gear 12. The rotation of the circular gear 12 is eccentric because the idler shaft 24 is positioned laterally from the geometric center of the circular gear 12.

The circular gear teeth 20 engage the linear gear teeth 46 at a point of contact 52 located at a maximum distance from the first axis 14 thereby directing the boat 50 in a straight direction. When the circular gear 12 rotates, the eccentricity of the circular gear 12 and the sinusoidal profile 18 of the linear gear 16 automatically vary the distance between the point of contact 52 and the first axis 14. In the embodiment shown, the leverage between the steering wheel 32 and the linear gear 16 is increased because the first axis 14 approaches the sinusoidal profile 18 of the linear gear 16. It is desirable to increase the leverage because as the boat turning radius decreases at higher speeds, fluid forces exerted on the rudder or marine engine 42 increase, thereby increasing the force required to turn the steering wheel 32.

Therefore, less revolutions are required to actuate the linear gear 16 in the negative amplitude region and more revolutions are required as the driving periphery approaches the end portion of the linear gear 16.

When the linear gear 16 is actuated, the cable 40 remotely pivots the rudder 42 located at the rear of the boat 50. As stated, in addition to the cable 40 shown, the linear gear 16 may also include another cable extending to the rear of the boat 50, as known. Also, a rudder could be an outdrive of an inboard/outboard marine engine or an outboard marine engine.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A boat steering assembly of the type for actuating a steering element (42) in response to rotary inputs at a steering wheel (32) comprising;

a first axis (14);

rotary gear means including a rotary gear (12) supporting for rotation about said first axis (14), said gear (12) including a driving periphery (21) spaced radially form said first axis (14);

input means associated with said rotary gear means for rotating said gear (12) of said rotary gear means about said first axis (14), said input means including an intermediate idler gear (22) fixed relative to said gear (12) and disposed concentrically about said first axis (14) and a shaft gear (28) disposed in operative engagement with said idler gear (22) to rotate said gear (12) about said first axis (14) in response to rotation of said shaft gear (28);

output gear means (16, 16') including an engagement periphery (18, 18') for engaging said driving periphery (21) at a point of contact (52, 52');

said assembly characterized by said driving periphery (21) and said engagement periphery (18, 18') having profiles for automatically varying the distance between said first axis (14) and said point of contact (52, 52') as said rotary gear means rotates to increase the leverage between said input means and said output gear means (16, 16') when the distance between said first axis (14) and said point of contact (52, 52') decreases.

2. An assembly as set forth in claim 1 further characterized by said gear (12) of said rotary gear means comprising a circular gear (12) having a center offset from said first axis (14) to maintain said circular gear (12) eccentrically with respect to said first axis (14).

3. An assembly as set forth in claim 2 further characterized by said driving periphery profile (21) including a plurality of teeth (20) spaced radially thereon for engaging said engagement periphery profile (18, 18').

4. An assembly as set forth in claim 3 further characterized by said engagement periphery profile (18, 18') including a plurality of teeth (46, 46') spaced radially thereon for mating engagement with said teeth (20) of said driving periphery profile (21).

5. An assembly as set forth in claim 4 further characterized by said shaft gear (28) having a smaller diameter than said idler gear (22) for reducing the number of revolutions of said idler gear (22) with respect to said shaft gear (28).

6. An assembly as set forth in claim 5 further characterized by said idler gear (22) having a larger diameter than said circular gear (12).

7. An assembly as set forth in claim 6 further characterized by said idler gear (22) including a plurality of teeth (26) spaced radially thereon for engaging said shaft gear (28).

8. An assembly as set forth in claim 7 further characterized by said shaft gear (28) including a plurality of teeth (30) spaced radially thereon for mating engagement with said teeth (26) of said idler gear.

9. An assembly as set forth in claim 8 further characterized by including an idler shaft (24) on said first axis (14) for supporting said idler gear (22) during axial rotation thereon.

10. An assembly as set forth in claim 1 further characterized by said engagement periphery profile (18, 18') being partially sinusoidal for continuously engaging said driving periphery (21) as said circular gear (12) rotates eccentrically about said first axis (14).

11. An assembly as set forth in claims 10 or 9 further characterized by said engagement periphery profile (18,) being disposed on a linear output gear (16).

12. An assembly as set forth in claims 10 or 9 further characterized by said engagement periphery profile (18') being disposed on an elliptical output gear (16').

13. An assembly as set forth in claim 12 further characterized by said elliptical output gear being concentrically disposed on a third axis (58) spaced laterally from said first axis (24).

14. An assembly as set forth in claim 13 further characterized by said elliptical output gear (16') including a helix gear (54) for guiding said steering cable (40').

15. A boat steering assembly of the type for actuating a steering element (42) in response to rotary inputs at a steering wheel (32) comprising:

a first axis (14);

a circular intermediate idler gear (22) concentrically rotatably disposed about said first axis (14);

a circular rotary gear (12) operatively coupled to said idler gear (22) and supported for rotation about said first axis (14) and including a driving periphery having a plurality of teeth (20) spaced radially from said first axis (14);

a shaft gear (28) operatively engaging said idler gear (22) associated with said circular rotary gear (12) for rotating said circular rotary gear about said first axis (14) in response to rotation of said shaft gear (28);

output gear means (16, 16') including a partially sinusoidal engagement periphery (18, 18') having a plurality of teeth (46, 46') spaced thereon for engaging said driving periphery (21) at a point of contact (52, 52');

said assembly characterized by said driving periphery (21) and said engagement periphery (18, 18') having profiles for automatically varying the distance between said first axis (14) and said point of contact (52, 52') as said circular rotary gear (12) rotates to increase the leverage between said shaft gear (28) and said output gear means (16, 16') when the distance between said first axis (14) and said point of contact (52, 52') decreases.

16. A boat steering assembly of the type for actuating a steering element (42) in response to rotary inputs at a steering wheel (32) comprising:

a boat (50);

a submergable steering element (42) for directing the motion of said boat (50);

a steering cable (40) for transmitting motion between said steering wheel (32) and said steering element (42);

a first axis (14);

a circular intermediate idler gear (22) concentrically rotatably disposed about said idler shaft (24);

a circular rotary gear (12) operatively coupled to said idler gear (22) and supported for rotation about said first axis (14) and including a driving periphery (21) having a plurality of teeth (20) spaced radially from said first axis (14);

a shaft gear (28) operatively coupled to said steering wheel (32) and operatively engaging said idler gear (22) for rotating said circular rotary gear (12) about said first axis (14);

output gear means (16, 16') including a partially sinusoidal engagement periphery (18, 18') having a plurality of teeth (46, 46') spaced thereon for engaging said driving periphery (21) at a point of contact (52, 52');

said assembly characterized by said driving periphery (21) and said engagement periphery (18,18') having profiles for automatically varying the distance between said first axis (14) and said point of contact (52, 52') as said circular rotary gear (12) rotates to increase the leverage between said shaft gear (28) and said output gear means (16, 16') when the distance between said first axis (14) and said point of contact (52, 52') decreases.

* * * * *